US007628891B2

(12) United States Patent
Gronych et al.

(10) Patent No.: US 7,628,891 B2
(45) Date of Patent: Dec. 8, 2009

(54) APPARATUS FOR DEWATERING A FIBROUS WEB

(75) Inventors: Daniel Gronych, Heidenheim (DE); Robert Koplin, Steinheim (DE); Klaus Hermann, Giengen (DE); Georg Kleiser, Heubach (DE)

(73) Assignee: Voith Patent GmbH, Heidenheim (DE)

( * ) Notice: Subject to any disclaimer, the term of this patent is extended or adjusted under 35 U.S.C. 154(b) by 413 days.

(21) Appl. No.: 11/498,524

(22) Filed: Aug. 3, 2006

(65) Prior Publication Data

US 2007/0028481 A1 Feb. 8, 2007

(30) Foreign Application Priority Data

Aug. 5, 2005 (DE) ..... 10 2005 036 903
Aug. 5, 2005 (DE) ..... 20 2005 012 994 U

(51) Int. Cl.
*D21F 3/04* (2006.01)
*D21F 5/04* (2006.01)
*D21F 5/18* (2006.01)

(52) U.S. Cl. ..... 162/359.1; 162/360.3; 34/116; 34/123

(58) Field of Classification Search ..... 162/205, 162/206, 358.1, 358.3, 358.5, 359.1, 360.2, 162/360.3; 34/110, 113, 116, 123
See application file for complete search history.

(56) References Cited

U.S. PATENT DOCUMENTS 5,393,383 A * 2/1995 Karvinen et al. ..... 162/274
5,743,024 A * 4/1998 Oechsle ..... 34/447
5,865,954 A * 2/1999 Laapotti ..... 162/205
5,876,565 A * 3/1999 Laapotti ..... 162/360.2
6,134,804 A 10/2000 Oechsle et al. ..... 34/114
6,197,159 B1 * 3/2001 Meinecke et al. ..... 162/205
6,294,050 B1 * 9/2001 Oechsle et al. ..... 162/207
6,383,340 B1 * 5/2002 Meschenmoser ..... 162/205

(Continued)

FOREIGN PATENT DOCUMENTS

DE 100 19 474 * 1/2001

(Continued)

OTHER PUBLICATIONS

DE 103 42 733, Apr. 2005, English language machine translation, EPO.*

(Continued)

*Primary Examiner*—Eric Hug
(74) *Attorney, Agent, or Firm*—Taylor & Aust, P.C.

(57) ABSTRACT

An apparatus for treating a fibrous web, in particular a paper, board or tissue web including a press section and a drying section. The press section includes a central roll around which an at least substantially impermeable belt wraps, the fibrous web being removed from this impermeable belt and fed to the drying section. In this case, as viewed in the web running direction, the first drying group of the drying section includes at most three drying cylinders. In the exit region of the first drying cylinder of the first drying group, in which the fibrous web runs off the drying cylinder together with a permeable circulating belt or is removed from the drying cylinder by such a permeable circulating belt, a removal zone to which vacuum is applied is provided on the side of the permeable circulating belt that faces away from the fibrous web.

30 Claims, 2 Drawing Sheets

U.S. PATENT DOCUMENTS

| | | | | |
|---|---|---|---|---|
| 6,442,865 | B1 * | 9/2002 | Wolf et al. | 34/114 |
| 6,638,395 | B1 | 10/2003 | Elenz | 162/202 |
| 6,658,758 | B2 * | 12/2003 | Kahl et al. | 34/117 |
| 6,662,468 | B2 * | 12/2003 | Juppi et al. | 34/454 |

FOREIGN PATENT DOCUMENTS

| | | | |
|---|---|---|---|
| DE | 102 59 379 | | 12/2002 |
| DE | 103 06 247 | * | 8/2004 |
| DE | 103 42 733 | * | 4/2005 |
| EP | 0 989 232 | | 7/1999 |
| EP | 1 158 092 | | 3/2001 |

OTHER PUBLICATIONS

DE 103 06 247, Aug. 2004, English language machine translation, EPO.*

DE 100 19 474, Jan. 2001, English language machine translation, EPO.*

* cited by examiner

APPARATUS FOR DEWATERING A FIBROUS WEB

BACKGROUND OF THE INVENTION

1. Field of the Invention

The invention relates to an apparatus for treating a fibrous web, in particular a paper, board or tissue web, having a press section and a drying section.

2. Description of the Related Art

In order to express water from fibrous webs, central-roll press arrangements are often used. The fibrous or paper web is transferred to a smooth central roll from an impermeable dewatering medium, for example a felt. Further pressing in an additional nip is carried out on the smooth central roll. One example of such a press is what is known as the "DuoCentri-II" press. This can also be provided with a shoe press nip as a preceding nip or as the last nip. In order to remove the paper web into the drying section following the latter, a free draw is necessary, in which the paper web is drawn onto the first dryer fabric, unsupported by a clothing medium. In such a free draw, a web break often occurs.

In order to avoid such web breaks, solutions have already been specified in which the web is led to the drying section supported by an impermeable belt. In this case, the impermeable belt, that is to say the central belt, as it is known, wraps around the central roll. Since absolute impermeability cannot be achieved, in many cases, the belt can also have a residual permeability of, for example, about 10 cfm.

One disadvantage of this solution is that the critical point for any possible web breaks is merely displaced from the central roll into the drying section. Breaks thus often occur in the leading region of the drying section.

What is needed in the art is an effective way to avoid or reduce web breaks.

SUMMARY OF THE INVENTION

The present invention is based on providing an improved apparatus in which the loadings on the fibrous web are reduced and, accordingly, the risk of a web break is reduced to a minimum.

According to the present invention, this object is achieved in that, as viewed in the web running direction, the first drying group of the drying section includes at most three drying cylinders. In the exit region, at least of the first drying cylinder of the first drying group, in which the fibrous web runs off the drying cylinder together with a permeable circulating belt or is removed from the drying cylinder by such a permeable circulating belt, a removal zone to which vacuum is applied is provided on the side of the permeable circulating belt that faces away from the fibrous web. On account of this construction, the result is a configuration of the drying section which is optimal with regard to the lowest possible loading of the fibrous web, in conjunction with a central roll of the press section around which the impermeable belt wraps. Draws and speed differences are minimized, and the speed differences that are still necessary are displaced rearward as far as possible into the drying section, where the fibrous web has a higher dryness and accordingly also a higher strength and is accordingly less sensitive with respect to a tensile stress. Because of the lower loading of the fibrous web, correspondingly higher machine running speeds are possible.

The removal zone to which vacuum is applied can expediently be formed by a stabilizer box or the like. The removal zone advantageously has a vacuum of at least 500 Pa applied to it, a vacuum of at least 1000 Pa preferably being provided.

According to one expedient practical embodiment of the apparatus according to the present invention, a removal zone to which vacuum is applied is assigned to all the drying cylinders of the first drying group. At least in the region of the first drying cylinder, the permeable circulating belt, on whose side faces away from the fibrous web, the removal zone is provided, and the permeable circulating belt can wrap around the drying cylinder together with the fibrous web. On the other hand, in the region of the last drying cylinder of the first drying group, the permeable circulating belt, can remove the fibrous web simply from the drying cylinder. The relevant permeable circulating belt, on whose side, facing away from the fibrous web, the removal zone is provided, therefore does not wrap around the relevant drying cylinder.

In another practical embodiment of the apparatus according to the present invention, the belt removing the fibrous web from the last drying cylinder of the first drying group is assigned to the following drying group. In order that the vacuum of the removal zone can always act optimally through the relevant permeable circulating belt, a cleaning unit is assigned at least to the permeable circulating belt of the first drying group. A high-pressure cleaning unit is expediently used. The cleaning unit provided is a traversing cleaning unit.

The permeable circulating belt that accepts the fibrous web can, in particular, be formed by a dryer fabric. The fibrous web is preferably transferred in a closed draw from the impermeable belt wrapping around the central roll into the drying section.

In order to increase the dryness further, and accordingly for the additional strengthening of the fibrous web, at least one high-performance drying unit is advantageously provided between the press including the central roll of the press section and the first drying cylinder of the first drying group of the drying section. Such a high-performance drying unit can in particular be gas operated. It is also of particular advantage if the fibrous web is supported continuously by a circulating belt in the region in which it is dried by way of the high-performance drying unit.

According to one expedient practical embodiment, the high-performance drying unit includes an evacuated roll and a gas-heated box or the like assigned to the latter. In this case, the fibrous web can be led around the roll together with a permeable circulating belt. Lying between the evacuated roll and the belt, and the heated box is the region of the roll around which the belt and the fibrous web wrap.

In order to increase the dryness further and to further strengthen the fibrous web, at least two high-performance drying units, following one another, in the web running direction are advantageously provided.

At least one high performance drying unit is preferably wrapped around by a permeable circulating belt assigned to the first drying group of the drying section. The evacuated roll of at least one high-performance drying unit can advantageously also be assigned its own permeable circulating belt which, apart from being led around the evacuated roll, is only led further around one or more guide rolls.

The fibrous web is preferably led in a closed draw from the impermeable belt wrapping around the central roll to the following high-performance drying unit. The fibrous web is removed from the impermeable belt wrapping around the central roll by a circulating transfer belt and is transferred to the evacuated roll, wrapped around by a permeable circulating belt, of a high-performance drying unit. In this case, the circulating transfer belt can, in particular, be a permeable transfer belt, which is led around a suction guide roll in the removal region.

It is possible, for example, for at least one steam blower box with a heat shield and/or at least one steam blower box with belt cooling to be provided as well. It being possible for the heat shield, or the belt cooling in particular, to be provided in order to protect the impermeable belt wrapping around the central roll.

In an expedient practical embodiment of the present invention, the central roll, wrapped around by the impermeable belt, forms two press nips following each other in the web running direction with two mating press units. The mating press unit, with which the central roll forms the first press nip on this central roll, is preferably a suction press roll.

The mating press unit, with which the central roll forms the first press nip on this central roll is advantageously assigned a further press unit in order to form a press nip preceding the two press nips on the central roll. This press nip, preceding the two press nips on the central roll can be formed by a roll nip or by a shoe press nip. In addition, the second press nip provided on the central roll can be formed by a roll nip or by a shoe press nip.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
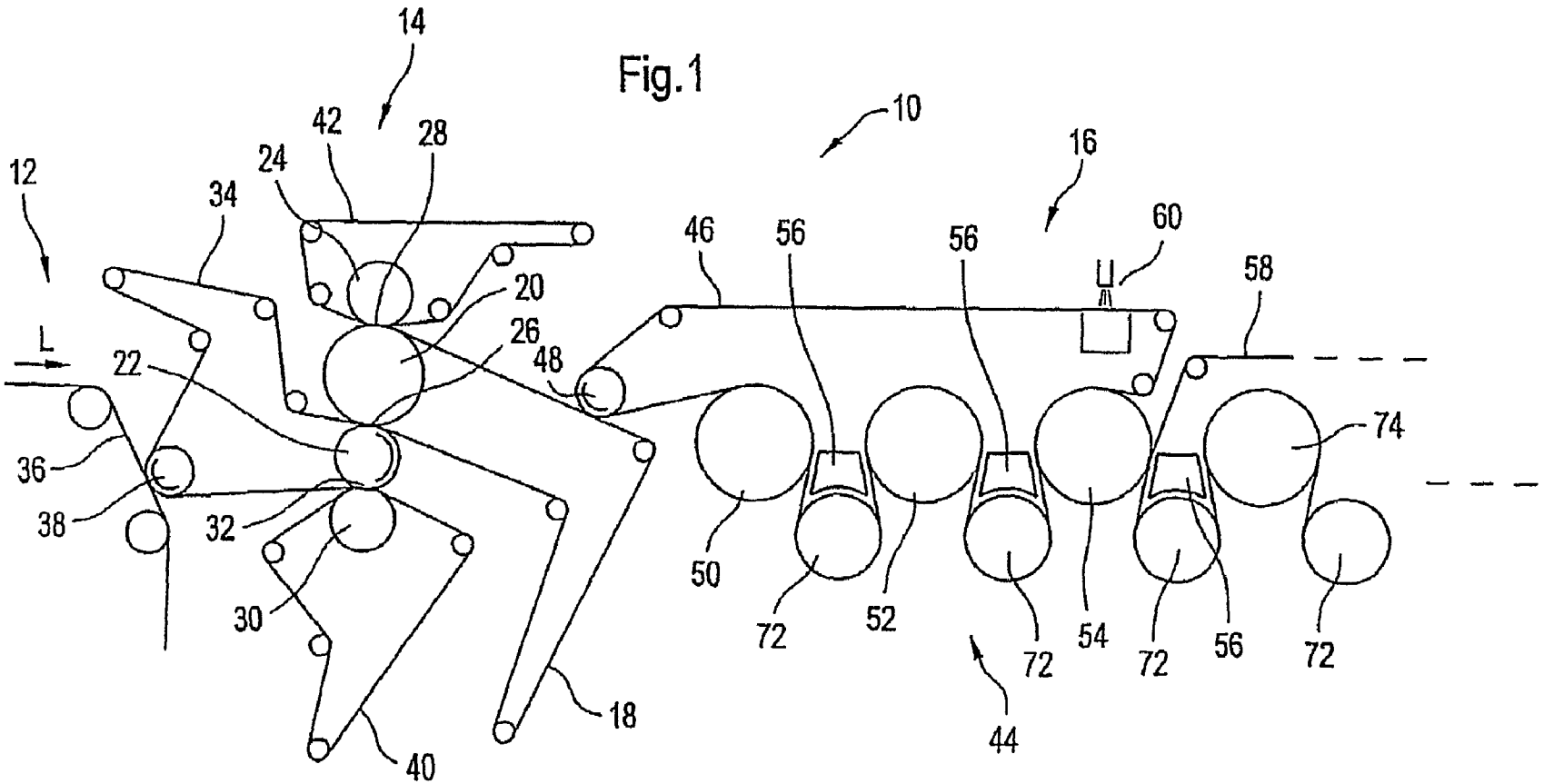
FIG. 1 shows a schematic partial illustration of an embodiment of an apparatus of the present invention for treating a fibrous web, in which the fibrous web is removed from the impermeable belt by a dryer fabric of the first drying group.

Referring now to the drawings, and more particularly to FIG. 1, there is shown, in a schematic partial illustration, an exemplary embodiment of an apparatus 10 for treating a fibrous web, which can be, in particular, a paper, board or tissue web. Apparatus 10 comprises a press section 14 following a former 12, and a subsequent drying section 16.

As can be seen from FIG. 1, a press arrangement assigned to press section 12 is provided, which includes a central roll 20 around which an impermeable belt 18 wraps. The fibrous web is removed by this impermeable belt 18 and is fed to drying section 16.

Central roll 20 around which impermeable belt 18 wraps forms with two mating press units 22 and 24 two press nips 26 and 28 following each other in a web running direction L.

Mating press unit 22, with which central roll 20 forms first press nip 26 on central roll 20, is a suction press roll.

Mating press unit 22, with which central roll 20 forms first press nip 26 on central roll 20, is assigned a further press unit 30, in order to form a press nip 32 preceding the two press nips 26 and 28 on central roll 20. Press nip 32 preceding the two press nips 26 and 28 can be formed by a roll nip or else by a shoe press nip. The relevant press unit 30 can therefore, in particular, also be provided as a shoe press unit, preferably a shoe press roll.

In addition, second press nip 28 on central roll 20 can be formed by a roll nip or by a shoe press nip. The relevant mating press unit 24 can therefore also be provided as a shoe press unit, for example, a shoe press.

Led around the suction press roll forming mating press unit 22 is a circulating belt 34, for example a felt, by which the fibrous web has previously been picked up from a mesh belt of former 12. In order to assist the relevant transfer, air-permeable belt 34 is led around an evacuated guide roll 38 in the transition region. A further circulating belt 40, for example, a felt is led around press unit 30 formed by a roll. The preceding press nip 32 can therefore in particular be double-felted.

Following the preceding press nip 32, the fibrous web, together with belt 34, is led further around mating press unit 22, formed by a suction press roll, and then into first press nip 26 provided on central roll 20, in the region of which it is picked up by the impermeable belt 18 wrapping around central roll 20. Following first press nip 26 on central roll 20, the fibrous web, together with impermeable belt 18, is led further around central roll 20 as far as second press nip 28 provided on central roll 20. Nip 28, as already mentioned, just like the preceding press nip 32, can be implemented as a roll nip or as a shoe press nip.

In contrast, a roll nip is formed between mating press unit 22, formed by a suction press roll here, and central roll 20. Mating press unit 24 forming together with central roll 20 second press nip 28 on central roll 20 is likewise once more wrapped around by a circulating belt 42, for example a felt.

Following second press nip 28 on central roll 20, the fibrous web is picked off impermeable belt 18 by a circulating permeable belt assigned to first drying group 44 of drying section 16, here a dryer fabric 46, for example, dryer fabric 46 being led around an evacuated guide roll 48 in the transfer region.

Using dryer fabric 46, the fibrous web is then fed to a first drying cylinder 50 of drying section 16. The fibrous web removed from impermeable belt 18 can be fed in a closed draw to drying section 16. First drying group 44 of drying section 16, viewed in web running direction L, includes at most three drying cylinders, illustrated as three drying cylinders 50, 52, and 54 in the present case.

In the exit region of these drying cylinders 50, 52, and 54 of first drying group 44, in which the fibrous web runs off respective drying cylinder 50, or 52 together with dryer fabric 46 or is removed by such a permeable circulating belt or dryer fabric 58 from drying cylinder 54, that is to say the last drying cylinder of first drying group 44, in each case a removal zone 56, to which vacuum is applied, is provided on the side of the relevant dryer fabric 46 or 56 facing away from the fibrous web. In this case, these removal zones 56, to which vacuum is applied, can be formed by a stabilizer box or the like.

In the present case drying cylinders 50, 52 and 54 of first drying group 44 are assigned a removal zone 56 to which vacuum is applied.

As can be seen from FIG. 1, in the region of first drying cylinder 50 and in the region of second trying cylinder 52, dryer fabric 46, on whose side facing away from the fibrous web respective removal zone 56 is provided, wraps around relevant drying cylinder 50 or 52 together with the fibrous web.

On the other hand, the fibrous web is simply removed from last drying cylinder 54 of first drying group 44 by dryer fabric 58. Dryer fabric 58 does not also wrap around drying cylinder 54. Before the transfer of the fibrous web from this last drying cylinder 54, dryer fabric 46 assigned to first drying group 44 is led away from drying cylinder 54.

As can be seen from FIG. 1, the belt or dryer fabric 58 removing the fibrous web from last drying cylinder 54 of first drying group 44 is assigned to the following drying group.

The permeable circulating belt or mesh belt 46 assigned to first drying group 44 is assigned a cleaning unit 60, which can in particular be a high-pressure cleaning unit. In the present case, a traversing high-pressure cleaning unit is provided.

Figure 2:
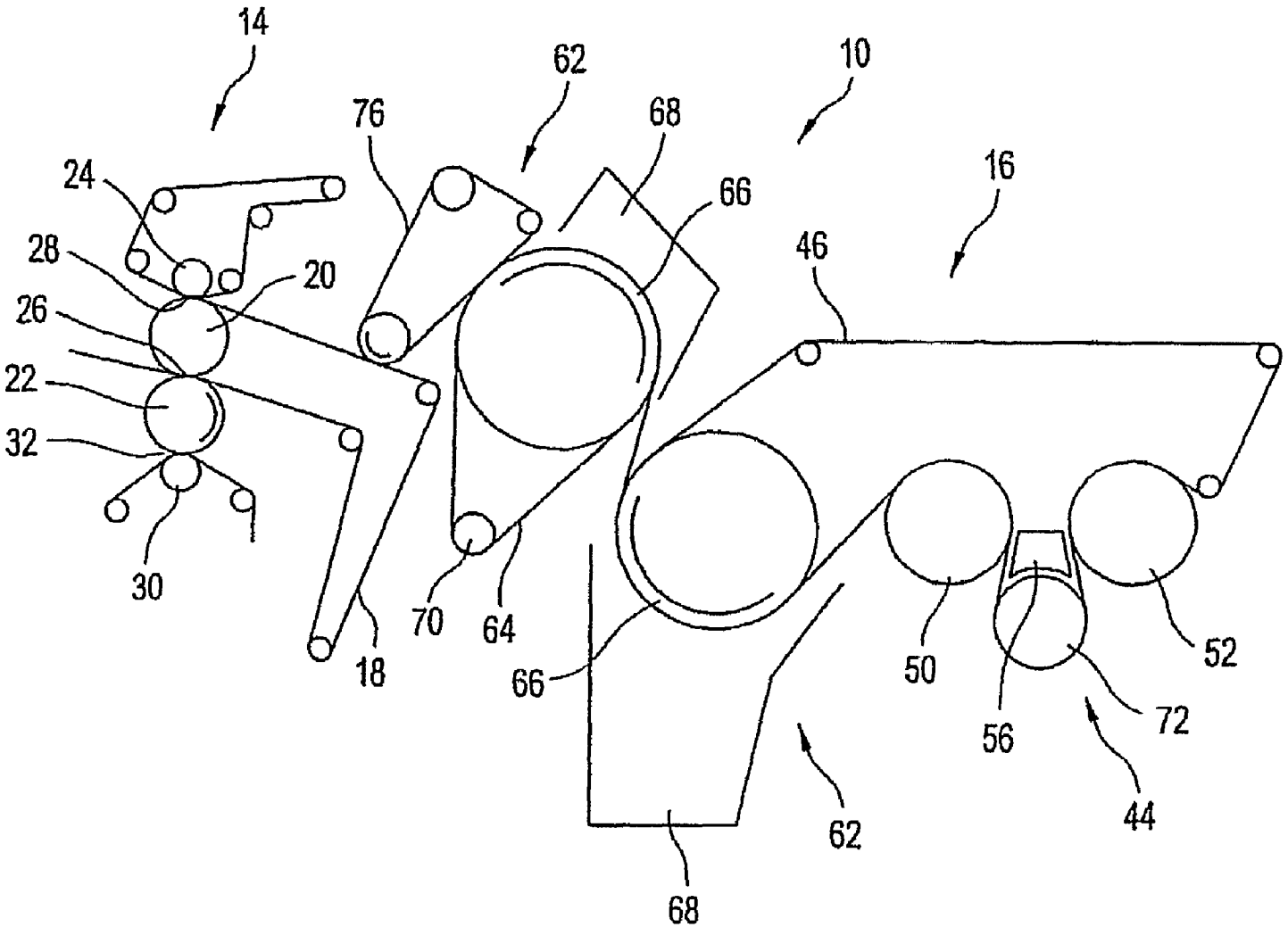
FIG. 2 shows a schematic partial illustration of a further embodiment of the apparatus of FIG. 1, in which, for example, two high-performance drying units are assigned between the press including the central roll and the first drying cylinder.

The embodiment of the present invention shown in FIG. 2 differs from that according of FIG. 1 substantially in the fact that, between the press having central roll 20 of press section 14 and first drying cylinder 50 of first drying group 44 of drying section 16, at least one, in the present case two, high-performance drying units 62 are provided. In this case, these high-performance drying units 62 can in particular be gas-operated. As can be seen in FIG. 2, in the regions in which it is dried by way of high-performance drying units 62, the fibrous web is supported continuously by respective circulating belt 64 or 46. High-performance drying units 62 each include an evacuated roll 66 and a gas-heated box 68 is assigned thereto.

In the region of the first high-performance drying unit 62, the fibrous web is led around roll 66 together with a permeable circulating belt 64, lying between evacuated roll 66 and the belt 64. Heated box 68 is assigned to the region of roll 66 around which belt 64 and the fibrous web wrap.

In the region of the second high-performance drying unit 62, the fibrous web is led around roll 66 together with dryer fabric 46 of first drying group 44, lying between evacuated roll 66 and dryer fabric 46. Heated box 68 is again assigned to the region of roll 66 around which the permeable circulating belt or dryer fabric 46 and the fibrous web wrap.

The first high-performance drying unit 62 is therefore assigned its own permeable circulating belt 64 which, in addition to being led around evacuated roll 66, is also led only around a guide roll 70. In contrast, a dryer fabric 46 assigned to first drying group 44 is led around roll 66 of the second high-performance drying unit and is subsequently led, for example, around two drying cylinders 50, and 52, and a suction deflection roll 72 located between them. In the present case, drying group 44 includes only two drying cylinders 50, and 52. In the embodiment of the present invention according to FIG. 1 appropriate suction deflection rolls 72 are provided between drying cylinders 50, 52, and 54, and a further drying cylinder 74 assigned to the second drying group.

In one exemplary embodiment of the present invention, reproduced in FIG. 2, the fibrous web is led in a closed draw from impermeable belt 18 wrapping around central roll 20 to the following high-performance drying unit 62. In the process, the fibrous web is removed from impermeable belt 18 wrapping around central roll 20 by a circulating transfer belt 76 and is transferred to evacuated roll 66 of first high-performance drying unit 62 around which permeable circulating belt 64 wraps.

Circulating transfer belt 76 can be a permeable transfer belt which, in the present case, is guided around a suction guide roll 78 in the removal region. Otherwise, this embodiment again has at least substantially the same construction as that of FIG. 1. Mutually corresponding parts are assigned the same designations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

10 Apparatus
12 Former
14 Press section
16 Drying section
18 Impermeable belt
20 Central roll
22 Mating press unit
24 Mating press unit
26 First press nip on the central roll
28 Second press nip on the central roll
30 Press unit
32 Preceding press nip
34 Circulating belt
36 Mesh belt
38 Evacuated guide roll
40 Circulating belt
42 Circulating belt
44 First drying group
46 Circulating belt, dryer fabric
48 Evacuated guide roll
50 First drying cylinder
52 Drying cylinder
54 Last drying cylinder
56 Removal zone
58 Circulating belt, dryer fabric
60 Cleaning unit
62 High-performance drying unit
64 Circulating belt
66 Evacuated roll
68 Gas-heated box
70 Guide roll
72 Suction deflection roll
74 Drying cylinder
76 Transfer belt
78 Suction guide roll
L Web running direction

What is claimed is:

1. An apparatus for treating a fibrous web, said apparatus, having a press section and a drying section, the press section, comprising:

a substantially impermeable belt; and a central roll around which said substantially impermeable belt wraps, the fibrous web being removed from said impermeable belt and being fed to the drying section, wherein, as viewed in a web running direction, a first drying group of the drying section includes:

a permeable circulating belt;

at most three drying cylinders including a first drying cylinder having an exit region in which the fibrous web runs off of said first drying cylinder together with said permeable circulating belt;

a removal zone to which a vacuum is applied on a side of said permeable circulating belt that faces away from the fibrous web; and at least one high-performance drying unit provided between the press section and said first drying cylinder of the first drying group of the drying section.

2. The apparatus of claim 1, wherein said removal zone to which said vacuum is applied is formed by a stabilizer box.

3. The apparatus of claim 1, wherein said removal zone has a vacuum of at least 500 Pa applied thereto.

4. The apparatus of claim 3, wherein said vacuum is at least 1000 Pa.

5. The apparatus of claim 1, further comprising a plurality of removal zones to which vacuum is applied, said at most three drying cylinders including a second drying cylinder and a third drying cylinder, one of said plurality of removal zones being assigned to second drying cylinder an to said third drying cylinder of the first drying group.

6. The apparatus of claim 1, wherein, at least in the region of said first drying cylinder, said permeable circulating belt on a side facing away from the fibrous web said removal zone is positioned, said permeable circulating belt previously wrapping around said first drying cylinder together with the fibrous web.

7. The apparatus of claim 1, wherein, in a region of the last drying cylinder of the first drying group in said web running direction said permeable circulating belt on whose side facing away from the fibrous web said removal zone is provided said permeable circulating belt removes the fibrous web from the last drying cylinder.

8. The apparatus of claim 7, further comprising a further drying group, said permeable circulating belt being assigned to said following drying group.

9. The apparatus of claim 1, further comprising a cleaning unit assigned to said permeable circulating belt that is assigned to the first drying group.

10. The apparatus of claim 9, wherein said cleaning unit is a high-pressure cleaning unit.

11. The apparatus of claim 9, wherein said cleaning unit is a traversing cleaning unit.

12. The apparatus of claim 1, wherein said permeable circulating belt is formed by a dryer fabric.

13. The apparatus of claim 1, wherein said high-performance drying unit is gas-operated.

14. The apparatus of claim 1, wherein the fibrous web is supported continuously by said circulating belt in a region in which said fibrous web is dried by said high-performance drying unit.

15. The apparatus of claim 1, wherein said high-performance drying unit includes:

an evacuated roll; and a gas-heated box assigned to said evacuated roll.

16. The apparatus of claim 15, wherein the fibrous web is led around said evacuated roll together with said permeable circulating belt, the fibrous web lying between said evacuated roll and said permeable circulating belt, said heated box being assigned proximate to said evacuated roll around which said permeable circulating belt and the fibrous web wrap.

17. The apparatus of claim 15, further comprising at least one more high-performance drying unit following said high-performance drying unit in said web running direction.

18. The apparatus of claim 17, wherein said evacuated roll of at least one high-performance drying unit is wrapped around by said permeable circulating belt assigned to the first drying group of the drying section.

19. The apparatus of claim 17, further comprising at least one guide roll, said evacuated roll of said at least one high-performance drying unit being assigned a permeable circulating belt that apart from being led around said evacuated roll is only led further around said at least one guide roll.

20. The apparatus of claim 17, wherein the fibrous web is led in a closed draw from said impermeable belt wrapping around said central roll to one of said high-performance drying units.

21. The apparatus of claim 20, further comprising a circulating transfer belt, the fibrous web being removed from said impermeable belt wrapping around said central roll by said circulating transfer belt, the fibrous web being transferred to said evacuated roll wrapped around by said permeable circulating belt of said high-performance drying unit.

22. The apparatus of claim 21, further comprising a suction guide roll, said circulating transfer belt being a permeable transfer belt that is led around said suction guide roll in the removal region.

23. The apparatus of claim 1, further comprising at least one of at least one heated box with a heat shield and at least one steam blower box with belt cooling positioned proximate the drying section.

24. The apparatus of claim 1, further comprising two mating press units, said central roll around which said impermeable belt wraps forms two press nips with said two mating press units including a first press nip and a second press nip, said second press nip following said first press nips in said web running direction.

25. The apparatus of claim 24, wherein one of said mating press units is a suction press roll.

26. The apparatus of claim 24, further comprising a further press unit, a first of said two mating press units in said web running direction being assigned said further press unit in order to form a third press nip preceding said first press nip and said second press nip.

27. The apparatus of claim 26, wherein said third press nip is formed by a roll nip.

28. The apparatus of claim 26, wherein said third press nip is formed by a shoe press nip.

29. The apparatus of claim 24, wherein said second press nip is formed by a roll nip.

30. The apparatus of claim 24, wherein said second press nip is formed by a shoe press nip.

* * * * *